US008096489B2

(12) United States Patent
Fedorov

(10) Patent No.: US 8,096,489 B2
(45) Date of Patent: Jan. 17, 2012

(54) SPRAYING DEVICE APPARATUS

(75) Inventor: Gennadi Fedorov, Blairstown, NJ (US)

(73) Assignee: Temptu, Inc.

( * ) Notice: Subject to any disclaimer, the term of this patent is extended or adjusted under 35 U.S.C. 154(b) by 231 days.

(21) Appl. No.: 12/150,345

(22) Filed: Apr. 28, 2008

(65) Prior Publication Data

US 2009/0266916 A1 Oct. 29, 2009

(51) Int. Cl.
*B05B 7/30* (2006.01)

(52) U.S. Cl. ..... 239/345; 239/375; 239/600

(58) Field of Classification Search ..... 239/302–379, 239/600

See application file for complete search history.

(56) References Cited

U.S. PATENT DOCUMENTS

| | | | | | |
|---|---|---|---|---|---|
| 555,669 | A | * | 3/1896 | Wold | 239/414 |
| 923,910 | A | | 6/1909 | Thompson | |
| 1,703,359 | A | | 2/1929 | Paasche | |
| 2,370,486 | A | * | 2/1945 | Paasche | 239/319 |
| 2,721,763 | A | | 10/1955 | Miner | |
| 2,936,959 | A | | 5/1960 | Nord et. al. | |
| 3,433,420 | A | | 3/1969 | Strout | |
| 4,079,893 | A | | 3/1978 | Bass | |
| 4,993,642 | A | | 2/1991 | Hufgard | |
| 5,156,684 | A | | 10/1992 | Mayer et al. | |
| 5,421,518 | A | | 6/1995 | Robisch et al. | |
| 5,779,157 | A | * | 7/1998 | Robisch et al. | 239/346 |
| 5,842,646 | A | | 12/1998 | Kitajima | |
| 5,975,435 | A | | 11/1999 | Whited, II | |
| 6,105,881 | A | * | 8/2000 | Kitajima | 239/353 |
| 6,341,736 | B1 | | 1/2002 | Liao | |
| 6,425,536 | B2 | | 7/2002 | Namura | |
| 6,892,960 | B2 | * | 5/2005 | Ptak et al. | 239/398 |
| 6,997,396 | B2 | | 2/2006 | Fedorov | |
| 7,070,124 | B1 | | 7/2006 | Juo | |
| 7,090,149 | B2 | * | 8/2006 | Fedorov | 239/346 |
| D534,617 | S | | 1/2007 | Fedorov | |
| 7,159,796 | B2 | | 1/2007 | Yquel | |
| 2005/0016448 | A1 | | 1/2005 | Dilou | |
| 2005/0072860 | A1 | | 4/2005 | Fedorov | |
| 2006/0243824 | A1 | | 11/2006 | Juo | |
| 2007/0090206 | A1 | | 4/2007 | Barch et al. | |
| 2007/0095942 | A1 | | 5/2007 | Ray et al. | |
| 2008/0078849 | A1 | | 4/2008 | Fox | |

FOREIGN PATENT DOCUMENTS

| | | | |
|---|---|---|---|
| CA | 2152406 | A1 | 12/1996 |

* cited by examiner

*Primary Examiner* — Dinh Nguyen

(74) *Attorney, Agent, or Firm* — Stephen E. Feldman; Feldman Law Group, P.C.

(57) ABSTRACT

A spraying device includes a housing that has a spraying unit and a trigger assembly. The spraying unit is a removable insert within the housing. The spraying unit includes an air chamber that is coupled to a liquid tank. A front end portion of the air chamber has a nozzle. The air chamber receives a liquid tube that opens in the nozzle. The liquid tube receives a needle and the needle and the liquid tube are coaxial with each other. The trigger assembly controls the flow of liquid through the liquid tube by positioning a tapered front end of the needle. The trigger assembly includes a trigger that has a first position and a second position. In the first position, the opening of the liquid tube is closed by the needle. In a second position, the liquid tube is opened to discharge a liquid from an opening of the liquid tube.

20 Claims, 4 Drawing Sheets

SPRAYING DEVICE APPARATUS

BACKGROUND OF THE INVENTION

1. Field of the Invention

The invention relates to spraying devices. In particular, the invention relates to a spraying device having a removable spraying unit which controls the amount of liquid in the spray.

2. Description of the Related Art

The prior art has several spraying devices for dispensing liquids, such as inks and cosmetics. These devices generally include a source of pressurized air and/or liquid tank. The liquid in the tank is sprayed with a mechanism that works on the Venturi effect, wherein the flow of spray is controlled by controlling the rate of pressurized air flow.

The spraying devices in the prior art generally use a needle supported in the axial position to control the flow of the liquid of the spraying device. The spraying devices also include a valve that controls the intake of compressed air in the spraying devices. The needle and the valve are generally operated by a same trigger which proves to be inconvenient since independent control of the liquid is needed.

The controlling mechanisms of the air and the ink flow include a plurality of complex parts which are generally not removable and replaceable. For example, the components of the spraying device, such as the needle and liquid tube, are not removable either for cleaning or for refilling the liquid and are also difficult to maintain and repair. One or two parts of the spraying devices in the art are removable for maintenance, however, the complete spraying mechanism is permanently fixed in the spraying device.

Thus, there is a need for a dispensing device which includes a spraying unit that is removable so that the flow of liquids in the spray can be controlled by a trigger. Further, a spraying unit is needed that allows for fine adjustment of the liquid flow.

SUMMARY OF THE INVENTION

A spraying device is described that includes a spraying unit and a trigger assembly which are positioned in the housing of the spraying device. The spraying unit is defined by a first shell and a second shell that define a spraying unit cavity, a handle portion, and a slot for positioning a trigger. The spraying unit is a removable insert in the spraying unit cavity. The spraying unit includes a liquid tank that is coupled with an air chamber. The air chamber receives a liquid tube that receives a needle. In one embodiment, the air chamber, the liquid tube, and the needle are coaxial with a longitudinal axis.

The trigger assembly includes a hook, a spring, and a trigger. The hook is adapted to securely hold a rear end portion of the needle. The spring is coupled with a post of the trigger to retain the position of the trigger. The trigger is pivoted in the housing in a predefined arrangement. The trigger has a first position and a second position.

In one embodiment, in the first position, the trigger is positioned upwards so that an opening of the liquid tube is closed by a tapered front end portion of the needle. In the second position, the trigger is downwardly pressed to open the liquid tube to discharge a liquid from an opening of the liquid tube. The tank includes a first opening with a collar and a second opening with a guide that has a rear cap. The rear cap receives the needle through a hole in a rear end of the cap.

In one embodiment, the air chamber has a front end portion which includes a nozzle and a rear end portion that includes a circular projection along an internal surface. The liquid tube has a front end portion which has an opening that is in close proximity with the nozzle. A rear end portion of the liquid tube opens in the tank. The needle has a tapered front end and a rear end. The tapered front end forms a pointed tip and the rear end is coupled with a device engaging trigger.

In one embodiment, the needle passes through the tank and liquid tube towards the nozzle so that the tip of the needle is positioned in the opening of the liquid tube. The needle includes a stopper which is positioned in the cap with a sealing gasket, a retainer, and a spring. The spring is positioned between the retainer and the stopper to produce a spring force which brings the needle forward to close the liquid tube when the trigger is released.

In another embodiment, the first and second body shells include a socket and a receptacle having a protrusion. The trigger includes a pair of rounded projections. Each of the projections is inserted in its respective socket to pivot the trigger. The housing has a rear end portion which includes an air inlet that receives pressurized air through a hose. The air chamber includes an air connector which has a pair of sleeves that are adapted to receive the respective protrusions of the receptacle to position the air connector in the housing.

The front end of the liquid tube is tapered internally in accordance with the tapered pointed portion of the needle so that the liquid tube is closed by the pointed front end of the needle in the first position. The tank has a removable cover to refill the liquid in the tank. The amount of liquid in the spray flow delivered by the nozzle is controlled by an adjustable trigger.

In yet another embodiment, a spraying device for spraying cosmetics liquid is disclosed, without using a needle, which comprises a housing having a spraying unit cavity; a spraying unit which is removably located within the spraying unit cavity, the spraying unit comprising a liquid tank coupled to an air chamber, and a trigger assembly including a trigger. In this particular embodiment, the trigger opens air flow when pushed.

DETAILED DESCRIPTION OF THE INVENTION

Figure 1:
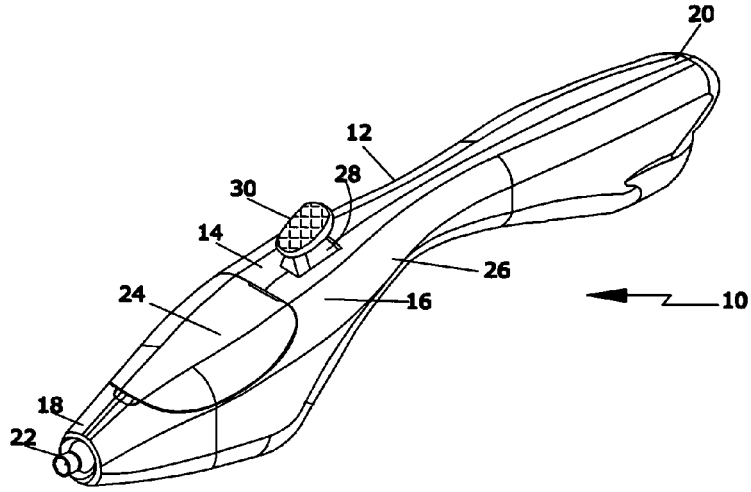
FIG. 1 is a top perspective view of a spraying device.

Although specific terms are used in the following description for the sake of clarity, these terms are intended to refer only to a particular structure of the invention selected for illustration in the drawings, and are not intended to define or limit the scope of the invention.

Referring to FIG. 1, an airbrush 10 according to a preferred embodiment of the present invention is shown that includes a housing 12 having a first body shell 14 and a second body shell 16 which are preferably made from ABS. The body shells 14 and 16 are coupled together with known techniques in the art, such as, glue and screws. The housing 12 has a front end portion 18 and a rear end portion 20. The front end portion 18 is preferably a pointed or a nose shaped portion that includes a nozzle 22 and an ink tank cover 24.

A middle portion of a first body shell and a second body shell defines a handle portion 26 and a predefined slot or opening 28 which includes trigger 30. Trigger 30 has a first position and a second position. The first position is the normal position of trigger 30. The trigger 30 is moved downwards from the first position to a second position to open the nozzle 22.

Figure 2:
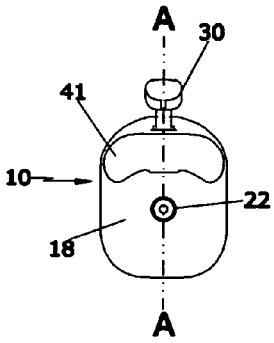
FIG. 2 is a front view of the spraying device of FIG. 1.
Figure 3:
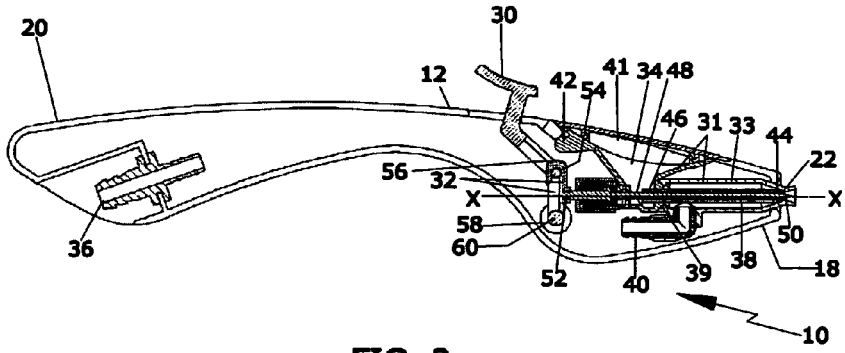
FIG. 3 is a sectional view of the spraying device of FIG. 1 taken along a plane-AA.

Referring to FIGS. 2 and 3, the front end portion 18 of the spraying device 10 includes a spraying unit 31 and a trigger assembly 32. Air spraying unit 31 includes a cylindrical air chamber 33 and a tank 34. Rear end portion 20 of the spraying device 10 includes an air inlet 36. The air chamber 33 is securely coupled at a predefined position with the tank 34. In a preferred embodiment, the air chamber 33 is approximately longitudinally coaxial with axis-X.

A front end portion of the air chamber 33 includes a nozzle 22. The rear end portion of the air chamber 33 includes a circular projection 39 along an internal surface. The air chamber 33 also receives a liquid tube 38 along a longitudinal axis-X. An air connector 40 is securely coupled with the air chamber 33.

The tank 34 is advantageously positioned in a spraying unit cavity 41 having a first body shell 14 and the second body shell 16. The tank is preferably positioned with a snap fit 42 or a press fit in the spraying unit cavity 41. The tank may be closed with a cover. The liquid tube 38 having a front end 44 and a rear end 46 is approximately coaxial with the air chamber 33. Liquid tube 38 is received in the air chamber 33 so that the rear end portion 46 opens in the tank 34 and the front end portion 44 opens in close proximity with the nozzle 22.

Liquid tube 38 includes a needle 48 which has a front end 50 and a rear end 52. Rear end 52 is coupled with a hook 54 of the trigger assembly 32 that is positioned in the housing 12. The needle 48 is coaxial with the liquid tube 38. Needle 48 passes through the tank 34 and liquid tube 38 towards a tapered opening in the front end 44 of liquid tube 38.

Trigger assembly 32 includes hook 54 which is mounted on the body of the trigger 30 that is adapted to securely hold the rear end 52 of the needle with the body of the trigger 30. The trigger 30 is preferably made from ABS or steel. Trigger 30 is pivoted in the housing 12 with a pair of sockets 58 which are located in each of shells 16 and 18, along with a pair of projections 60 of the trigger 30.

In yet another embodiment, the whole front portion of the airbrush is integrated with the tank/nozzle assembly and the whole assembly is inserted into the airbrush from the front.

Figure 4:
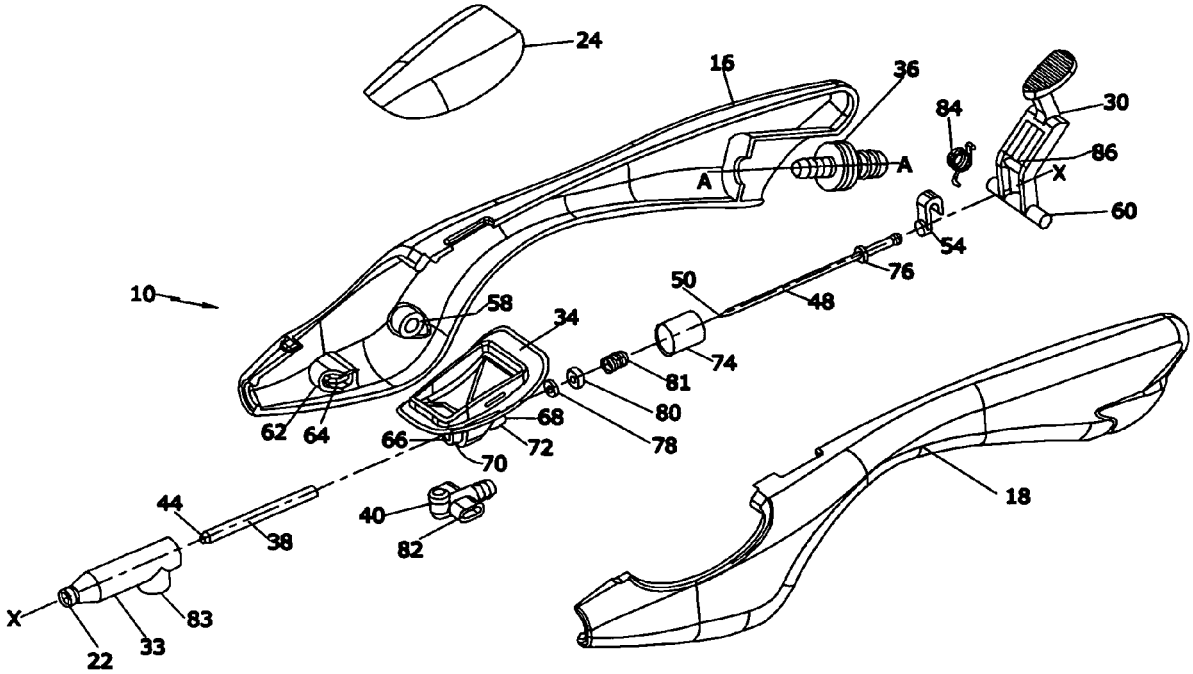
FIG. 4 is an exploded view of the spraying device of FIG. 1.

Referring to FIG. 4, an exploded view of the spraying device 10 along axis-X in accordance with the preferred embodiment of the present invention is shown. The first and second body shells 16 and 18 each include socket 58 and a receptacle 62. Each receptacle 62 includes a protrusion 64. Tank 34 includes a first opening 66 and a second opening 68 in a bottom portion of tank 34. Air inlet 36 is positioned in an opening defined by the body shells 16 and 18. A hose is preferably coupled with the air inlet to provide pressurized air from a source.

The first opening 66 has a collar 70 which includes a groove. The rear end portion of the liquid tube 38 is inserted in the tank 34 through the opening 66. The liquid tube 38 is received in the air chamber 33 which is securely coupled with the first opening 66. A rear end of the air chamber 33 is securely coupled with the collar 70 so that the groove of the collar 70 fits with the projection 39 in the end portion of the air chamber 33.

The second opening 68 of the tank includes a rounded guide 72 which is covered by a rear cap 74 that closes the opening 68. The guide 72 has a plurality of external threads on the outer surface. The cap 74 receives the needle 48 through a hole in a rear end of cap 74 having a diameter greater than the diameter of the needle 48. The needle 48 includes a stopper 76 that is positioned in the cap 74 with a sealing gasket 78, a retainer 80, and a spring 81. The spring 81 is positioned in the cap 74 between the retainer 80 and the stopper 76.

The air connector 40 includes a pair of sleeves 82. The air connector 40 is coupled with an air inlet 83 of the air chamber 33. The sleeves 82 are positioned in a receptacle 62 to receive the protrusions 64. A rubber sealing gasket is preferably adapted in the air connector 40.

The front end portion of the air chamber 33 has a nozzle 22 that receives front end 44 of the liquid tube 38 and tapered front portion 50 of the needle 48. The front end of the liquid tube 38 is tapered internally in accordance with the tapered pointed portion of the needle 48 so that the liquid tube 38 is closed by the pointed front end 50 of the needle 48 in the first position. The rounded projections 60 of the trigger 30 are positioned in the respective sockets 58 of the first and second body shells 16 and 18. A trigger spring 84 is advantageously mounted on a post 60 of the trigger 30. The hook 54 is engaged to a post 86. The tank 34 is closed with cover 24 that is removable. It is, however, understood that the cover 24 can be molded as an integral part of tank 34

Figure 5:
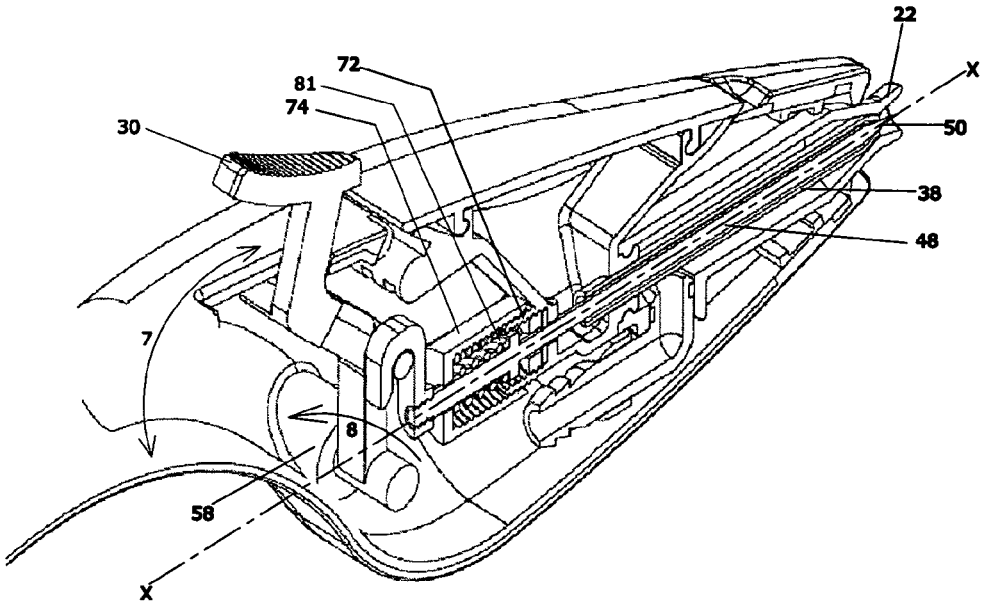
FIG. 5 is an enlarged perspective view of a front end portion of the air brush of FIG. 4.
Figure 6:
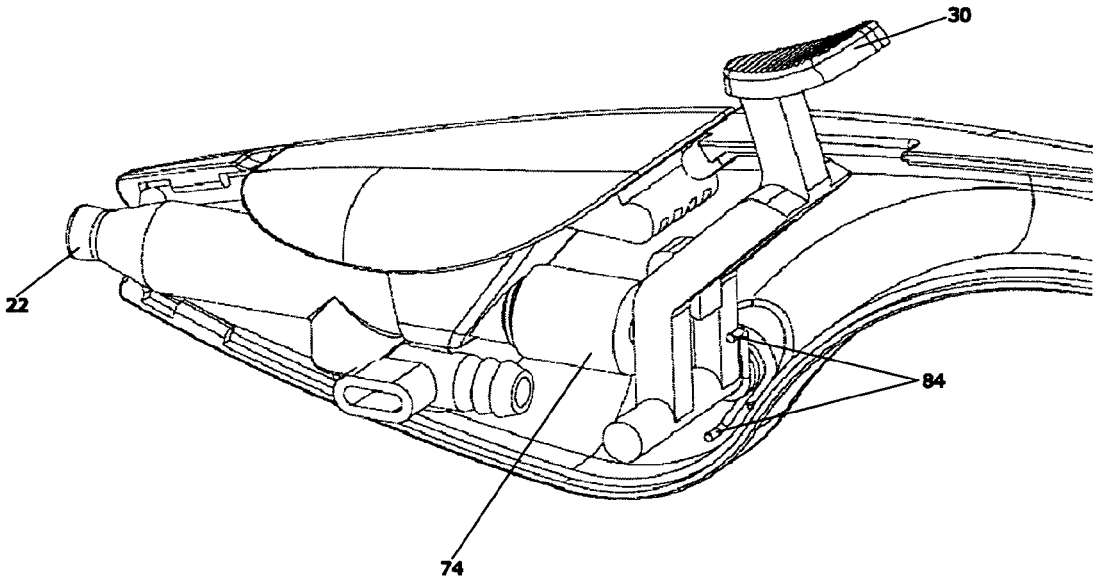
FIG. 6 is a side perspective view of the front end portion of the spraying device of FIG. 1 with a second shell removed.

Now referring to FIGS. 5 and 6, a method of controlling the flow of liquid with the trigger 30 is described. In one embodiment, the amount of liquid in the flow of the atomized mixture delivered by nozzle 22 is advantageously controlled by adjusting trigger 30. Trigger 30 is completely released in the first position. In the first position, the tapered pointed portion 50 of the needle 48 is positioned so that the opening of the liquid tube 38 is completely closed. The rear cap 74 is threadably engaged with guide 72 along longitudinal axis-X. The rear cap 74 advantageously retains needle 48 and spring 81 in predefined working positions.

In a second position, trigger 30 is pressed in a backward manner as indicated by arrow 7 so that the needle 48 moves longitudinally backwards along axis-X to allow full discharge of the liquid through the liquid tube 38. When the trigger 30 is pressed from the first position to the second position, trigger 30 moves in the backward direction as indicated by the arrow 8 about the socket 58. The front end portion 50 of the needle is pulled back from the nozzle 22 by pressing the trigger 30 along axis-X.

The spring force of spring 81 has a tendency to push the stopper in the forward direction, and thereby, retains a tip of needle 48 to the original position. The trigger spring 84 pushes the trigger 30 in an upward motion to regain the first position. The spring force of spring 84 is added to the force greater than the spring force created by spring 81, both of which push the trigger to the first position when the trigger 30 is released. The first position is the normal position of the spraying device 10. The trigger 30 and the needle 48 may move to the first position as soon as trigger 30 is released from the second position.

In another embodiment, the needle 48 of the spraying unit is coupled with the trigger 30 with a pair of magnets (not shown) having opposite polarities. A first magnet is securely coupled with the needle 48. A second magnet 98 is positioned on the trigger 30. The magnets securely couple the trigger 30.

Figure 7A:
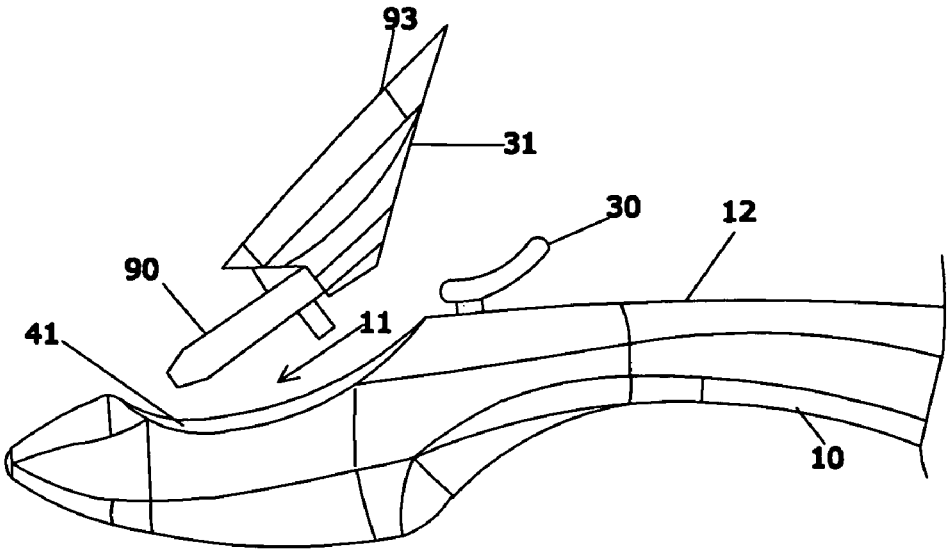
FIG. 7A-C show steps involved in a method of inserting the spraying unit in the spraying device of FIG. 1.
Figure 7B:
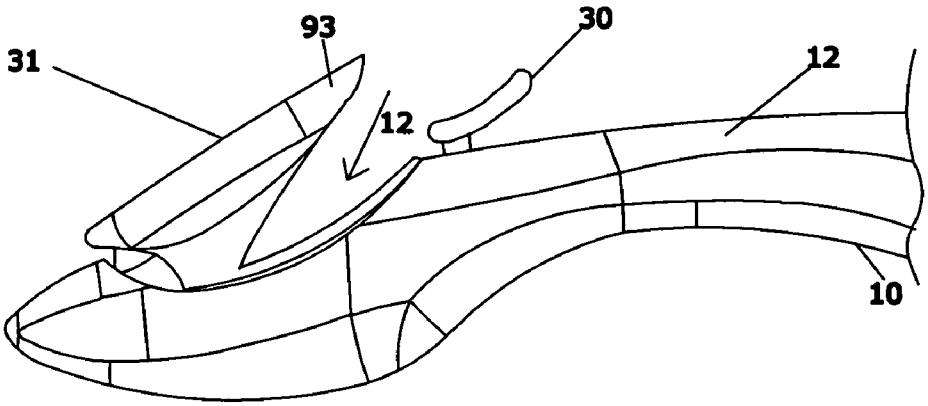
Figure 7C:
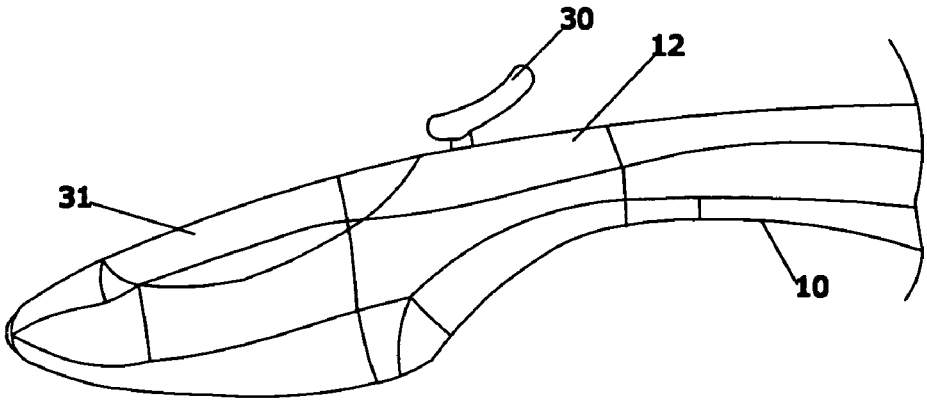

As shown in FIGS. 7A-7C, steps involved in a method of positioning spraying unit 31 in the spraying device 10 are described. In a first step, a front end portion 90 of the spraying unit 31 is inserted into the predefined cavity 41 in housing 12 of the spraying device 10 as indicated by arrow 11. In a second step, rear part 93 of the spraying unit 31 is moved in a downward manner as indicated by arrow 12.

In the third step, the rear end portion 52 of the needle 48 is securely fitted with the hook 54. Hook 54 is then securely coupled with post 86 of the trigger 30 (Ref. FIG. 4). In a fourth step, the rear end 93 of the spraying unit 31 is fitted onto with the spraying device body.

Now referring to FIGS. 1-7, in operation, liquid is stored in the tank 34 that is detachably housed in the cavity 92. The liquid is conducted to the nozzle 22 through the liquid tube 38. A pressurized gas from a source, for example, an air compressor, cam operated piston pump, battery operated piston cylinder arrangement, is supplied to the air chamber 33 through the air connector 38.

The pressurized air is allowed to escape through the constricted opening of the nozzle 22 that creates a low pressure zone in the tip of the nozzle 22. The Venturi Effect pulls the liquid out of the liquid tube 38 into air stream. Liquid mist of small particles is formed which is dispensed out from the nozzle 22 of the spraying device 10.

In one embodiment, the hook 54 moves the needle 48 towards the nozzle 22 opening when the trigger 30 is pressed to achieve the second position. While the trigger 30 is pressed, stopper 76 compresses spring 84 and needle 48 moves longitudinally backwards. Spring 84 is also in compression in this position. The liquid fluid enters through the opening 40 in liquid tube 38 in the passage surrounding the needle 48. The needle sealing gasket 78 restricts the flow of the liquid in the reverse direction towards the rear cap 74. The flow is controlled by pressing the trigger 30 and by maintaining various intermediate positions of trigger 30 between the first and the second position.

In one embodiment, the stopper 76 can travel in the direction of the nozzle up to a predetermined point on guide 72, at which time, the nozzle 22 is completely closed in the first position. In another embodiment, the stopper 76 can travel in the direction of the hook 54 up to the rear wall of the rear cap 74. The adjustment of the rear cap 74 allows the user to preset the amount of the liquid in the spray.

In one embodiment, the spraying device 10 may be used as a cosmetic tanning air brush. The liquid can be any cosmetic, liquid, ink, etc. Cap 74 is knurled for better grip while rotating the cap. The cover 24 of the tank 34 is removable to refill the liquid in the tank. The airbrush 10 has an inbuilt handle portion 26 for better handling.

It should be noted that in other embodiments, the spraying device apparatus may be attached, but not limited to, household items such as a compressor.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A spraying device for spraying liquid comprising;

a housing having a handle and a spraying unit cavity;

the spraying unit cavity comprises an elongated cavity located substantially in the housing;

a spraying unit completely removably locatable within the spraying unit cavity, the spraying unit comprising a liquid tank coupled to an air chamber, the spraying unit includes a liquid tube and a needle, said spraying device unit fitting into and removable as a substantially single unit from the spraying unit cavity, and a trigger assembly including a trigger in said housing, wherein said needle acts on said liquid tube when said trigger is actuated.

2. The spraying device of claim 1, wherein the tank has a first opening with a collar and a second opening with a guide that includes a rear cap.

3. The spraying device of claim 2, wherein the rear cap receives the needle through a hole defined in a rear end of the rear cap having a diameter that is greater than the diameter of the needle.

4. The spraying device of claim 2, wherein the needle passes through the rear cap, the tank, and the liquid tube towards the nozzle, and wherein the tip of the needle is positioned in the opening of the liquid tube.

5. The spraying device of claim 2, wherein the needle includes a stopper which is positioned in the rear cap with a sealing gasket, a retainer, and a spring.

6. The spraying device of claim 5, wherein the spring is positioned between the retainer and the stopper to produce a spring force which brings the needle forward to close the liquid tube when the trigger is released.

7. The spraying device of claim 2, wherein the collar has a groove which is adapted to receive a rear end portion of the air chamber.

8. The spraying device of claim 1, wherein the air chamber has a front end portion and a rear end portion, wherein the front end portion includes a nozzle, and the rear end portion includes a circular projection along an internal surface of said rear end portion.

9. The spraying device of claim 1, wherein the liquid tube has a front end portion and a rear end portion, the front end portion having an opening that is in close proximity with the nozzle, wherein the rear end portion opens into the tank.

10. The spraying device of claim 1, wherein the trigger assembly comprises a hook and a spring, the hook being adapted to securely hold a rear end portion of the needle, the spring being coupled with a post of the trigger, and the trigger being pivoted in the housing in a predefined arrangement;

said trigger having a first position, wherein the trigger is positioned upwards that the liquid tube is closed by the needle; and said trigger having a second position, wherein the trigger is pressed downwards from the first position to the second position to open the liquid tube so as to discharge a liquid from an opening of the liquid tube.

11. The spraying device of claim 10, wherein the needle comprises a tapered front end and a rear end, wherein the tapered front end defines a pointed tip, and wherein the rear end is coupled with the hook.

12. The spraying device of claim 10, wherein the first opening receives the rear end portion of the liquid tube.

13. The spraying device of claim 10, wherein the front end of the liquid tube comprises an internally tapered front end portion, wherein the internally tapered front end portion of the liquid tube is closed by the pointed front end of the needle in the first position.

14. The spraying device of claim 1, wherein the trigger comprises a pair of rounded projections, wherein each of the projections is inserted in its respective socket to pivot the trigger.

15. The spraying device of claim 1, wherein the housing comprises a rear end portion that includes an air inlet adapted to receive pressurized air through a hose.

16. The spraying device of claim 1, wherein the air chamber comprises an air connector which includes a pair of sleeves that are adapted to receive the respective protrusions of the receptacle to position the air connector in the housing.

17. The spraying device of claim 1, wherein the tank comprises a removable cover to refill the liquid in the tank.

18. The spraying device of claim 1, wherein the housing comprises a first shell and a second shell.

19. The spraying device of claim 18, wherein the first body shell and the second body shell each has a socket and a receptacle and each said receptacle has a protrusion.

20. The spraying device of claim 1, wherein the housing comprises a handle and a trigger slot.

* * * * *